US005727294A

United States Patent [19]

Lathery et al.

[11] Patent Number: 5,727,294

[45] Date of Patent: Mar. 17, 1998

[54] APPARATUS AND METHOD FOR CONTINUOULSY KNITTING, SHRINKING AND TRANSFERRING THE BLANKS TO A REMOTE LOCATION

[75] Inventors: William M. Lathery, Germanton; Christopher R. Jones, Greensboro, both of N.C.

[73] Assignee: Sara Lee Corporation, Winston-Salem, N.C.

[21] Appl. No.: 640,537

[22] Filed: May 2, 1996

[51] Int. Cl.[6] ..... D05B 21/00; D05B 1/00

[52] U.S. Cl. ..... 28/153; 28/154; 112/470.15; 68/5 D; 34/618; 223/43; 223/76

[58] Field of Search ..... 112/470.15, 470.08; 34/629, 618, 623; 66/148; 68/5 R, 5 D; 28/153, 154, 123, 124; 223/43, 60, 75, 76, 77, 112; 2/239

[56] References Cited

U.S. PATENT DOCUMENTS

| | | | |
|---|---|---|---|
| 3,686,726 | 8/1972 | Glaze, Jr. et al. | 68/5 R |
| 4,903,415 | 2/1990 | Cortese | 34/60 |
| 4,953,687 | 9/1990 | Gazzarrini | 112/121.29 |
| 4,954,045 | 9/1990 | Gazzarrini | 414/792.7 |
| 5,040,475 | 8/1991 | Fournier et al. | 112/121.15 |
| 5,323,626 | 6/1994 | Gazzarrini et al. | 34/565 |
| 5,511,501 | 4/1996 | Bell et al. | 112/470.5 |

*Primary Examiner*—Andy Falik

*Attorney, Agent, or Firm*—Kilpatrick Stockton LLP

[57] ABSTRACT

A continuous and uninterrupted process for knitting a plurality of cylindrical blanks, automatically transferring the knit blanks sequentially to a shrink apparatus, continuously shrinking the blanks for a predetermined period of time, and automatically transferring the shrunken blanks from the shrink apparatus to a remote location. The invention also includes an apparatus for carrying out the process having a shrink apparatus with a blank input conduit, a blank output conduit, a plurality of heating chambers, and means for transferring knitted tubular blanks from knitting machines to heating chambers. A heat source transfers heat to the heating chambers to heat and shrink the blanks, and an associated component automatically transfers the shrunken blanks to a remote location. The apparatus also includes an indexer carrying the heating chambers, appropriate conduit means for directing incoming and exhausting outgoing heated air, and a programmable controller for selectively displacing the indexer to coordinate the operation of the heat source with the other components of the apparatus.

12 Claims, 4 Drawing Sheets

APPARATUS AND METHOD FOR CONTINUOULSY KNITTING, SHRINKING AND TRANSFERRING THE BLANKS TO A REMOTE LOCATION

BACKGROUND OF THE INVENTION

1. Field of the Invention

The present invention relates to a continuous and uninterrupted process and apparatus for handling knit fabrics and more particularly to a process and apparatus for continuously knitting a plurality of cylindrical blanks used in the manufacture of pantyhose garments and automatically transferring the blanks sequentially to a shrinking apparatus where shrinking of the blanks takes place for a period of time. The shrunken blanks are thereafter automatically transferred to a remote location.

2. Description of the Prior Art

In the conventional manufacturing of knitted ladies fashion hosiery, construction commences with the production of a knit tube or blank as it is commonly referred to in the industry. A quantity of blanks are collected from a number of knitting machines and thereafter steam tumbled and scoured to shrink the blanks as much as possible to stabilize the knitted fabric. The movement of these blanks from the knitting area to the steaming and scouring equipment is usually through the use of carts or buggies constantly moving back and forth across the plant floor from one area to the other.

After the steam tumbling and scouring operation has been completed, the blanks are again collected on carts or buggies and moved to the cut and sew plant location. Pantyhose garments are formed from slitting two tubular blanks at a similar location at one end of the blank and sewing the blanks together along the slit edges. This joined section along the slit edges forms a panty portion of the garment. A knitted waistband is usually produced at one end of the blank during the knitting operation and is already in place when the sewing of the blanks together is accomplished. The blanks are then closed at the other open end to form the toe portions of the foot section of the garment.

These sewing steps have traditionally taken place in a different area of a plant. In some cases, they may take place in another plant. More recently, these operations have become automated to the extent that individual tubes can be automatically selected and positioned on equipment for slitting, joining the blanks by sewing around the slit edges, and moving the garments automatically to other automated equipment for closing the toes. The finished garments can then be sequentially stacked and packaged or moved to another area of the plant for dyeing. Again, whenever the garments are moved from one area to the other, they are positioned on carts or buggies that move back and forth through the plant, creating a crowded work place and unavoidable safety problems from time to time. The manufacturing process is rather slow in that loading and unloading the carts manually is time-consuming and the number of garments produced is limited by the operation.

While the advent of automated equipment to handle the selection and fabrication of tubes to form pantyhose garments was a major breakthrough in the industry when it was developed, there is still a need to improve the manufacturing procedures and maximize efficiency and production. It is to this need that the present invention is directed.

OBJECTIVES AND SUMMARY OF THE INVENTION

The purpose of the present invention, which will be described subsequently in greater detail, is to provide a process and apparatus for handling knit cylindrical blanks which has all of the advantages of prior art processes and machinery and more, and none of the disadvantages.

Another objective of the present invention is to provide a process of the character described that eliminates material handling between the knitting operation, the scouring and shrinking operation, and the sewing operation. Yet another objective of the present invention is to provide a process of the character described that eliminates the need for steam tumbling and scouring operations and equipment between the knitting and sewing stations.

A further objective of the present invention is to provide a process of the character described that is continuous in that knitted garments are continuously and sequentially moved to a shrink apparatus and after shrinking, are automatically transferred to a remote location for sewing or other activity.

Yet still another objective of the present invention is to provide apparatus of the character described that will be efficiently sized and operated between the knitting area and the cutting and sewing area to maximize efficiency, productivity and economy.

Yet still another further objective of the present invention is to provide an apparatus of the character described that can be utilized to automatically heat and shrink knit tubes received from the knitting area and continuously, after the shrinking operation, transfer those shrunken tubes to a packaging area where shipping cartons are automatically filled for movement to other locations to complete the cutting and sewing operation.

These objectives are accomplished by utilizing a process which includes knitting a plurality of cylindrical blanks sequentially, automatically transferring the knit blanks sequentially to a shrink apparatus, continuously shrinking the transferred blanks for a predetermined period of time, and automatically transferring the shrunken blanks to a remote location. Apparatus to carry out the process is a part of the present inventive concept and includes a plurality of knitting machines for knitting tubular blanks, a shrink apparatus for shrinking knit fabric produced and furnished by the knitting machines, and automatically transferring the shrunken blanks to a remote location which may be the site of an automatic pick-up, cut and sew apparatus for completely fabricating pantyhose garments or an automatic packaging apparatus for completely collecting and packaging the shrunken blanks for shipment. The shrinking apparatus itself includes an indexer, a plurality of heating and shrinking chambers mounted on the indexer, heat generating means furnishing heat for the heating and shrinking chambers, input means for conveying knitted fabric to the heating and shrinking chambers, and output means for removing the knitted fabric from the heating and shrinking chambers to a remote location. A programmable controller is utilized for selectively displacing the indexer to coordinate the operation of the heat generating means with the other components of the apparatus.

Thus, there has been outlined the more important features of the invention in order that the detailed description that follows may be better understood and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the arrangement of the components set forth in the following description or illustrated in the drawings. The invention is capable of other embodiments and of being practiced and carried out in various ways. It is also to be understood that the phraseology and terminology employed herein are for the purpose of description and should not be regarded as limiting in any respect. Those skilled in the art will appreciate that the concept upon which this disclosure is based may readily be utilized as a basis for designing other structures, methods and systems for carrying out the several purposes of this development.

It is important that the claims be regarded as including such equivalent methods and products resulting therefrom that do not depart from the spirit and scope of the present invention. The application is neither intended to define the invention of the application, which is measured by its claims, nor to limit its scope in any way.

Thus, the objectives of the invention set forth above, along with the various features of novelty which characterize the invention, are noted with particularity in the claims annexed to and forming a part of this disclosure. For a better understanding of the invention, its operating advantages and any specific results obtained by its use, reference should be made to the following detailed specification taken in conjunction with the accompanying drawings, wherein like characters of reference designate like parts throughout the several views.

DETAILED DESCRIPTION OF THE PREFERRED EMBODIMENT

Figure 1:
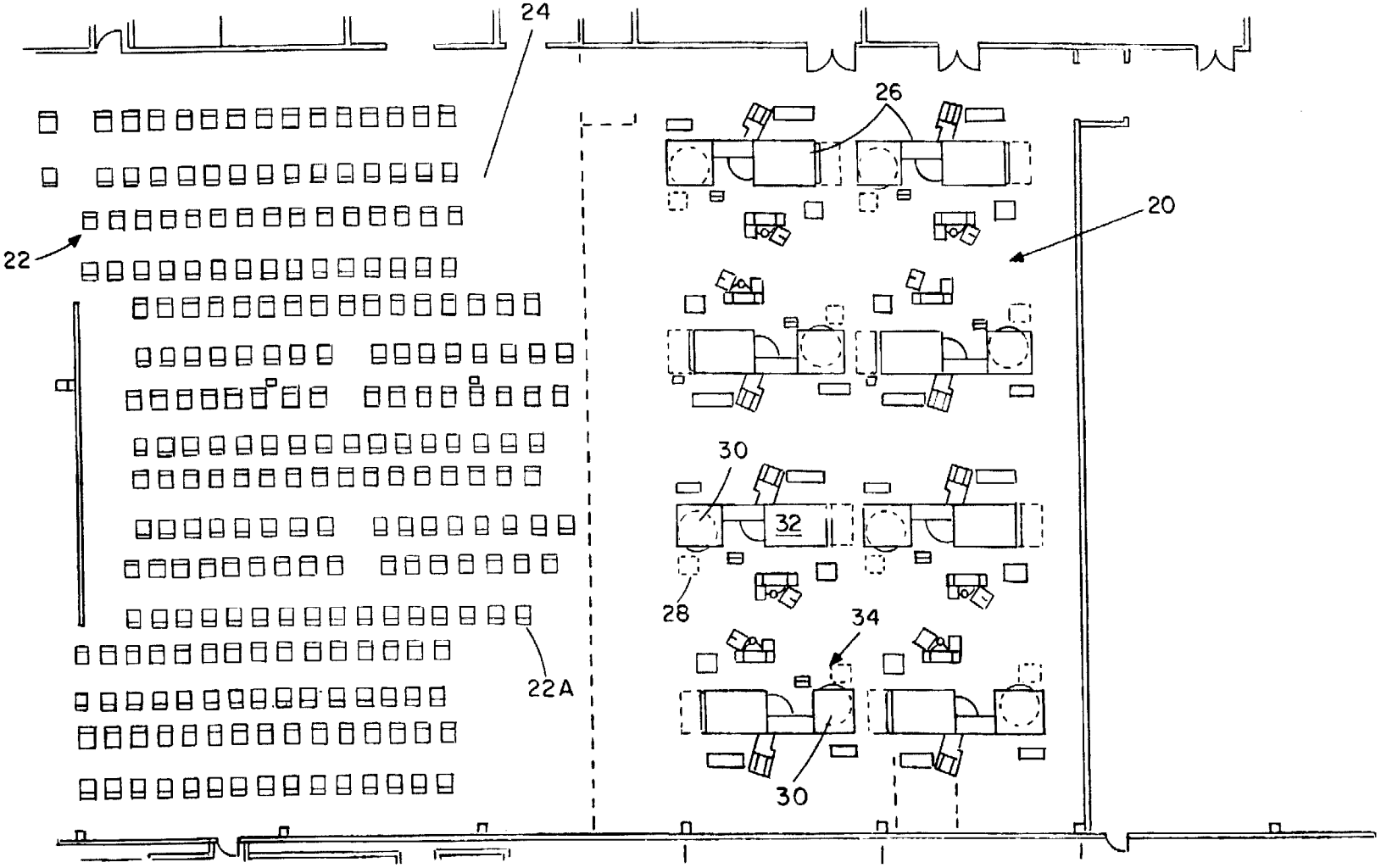
FIG. 1 is a plan view of an active floor of a hosiery manufacturing facility.
Figure 5:
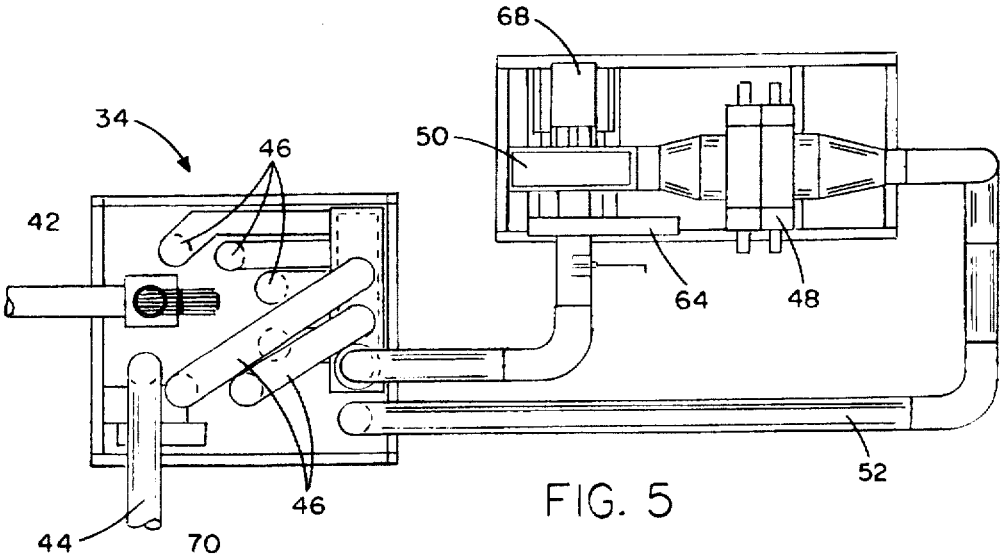
FIG. 5 is a plan view of the top of the shrinker shown in FIG. 4.
Figure 2:
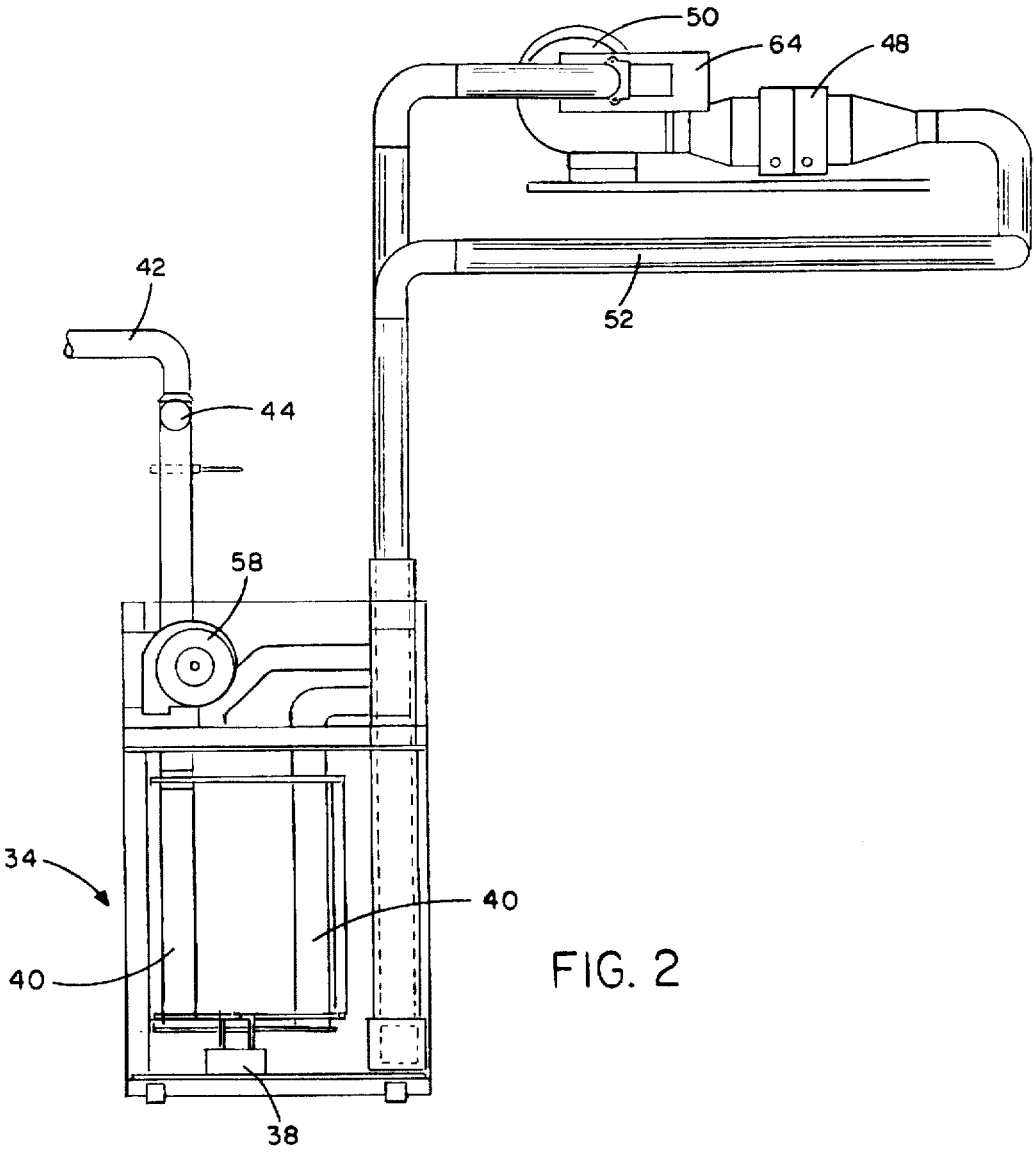
FIG. 2 is a side elevational schematic view of the shrink apparatus, the heat source, and the hot air circulating system connecting the apparatus and heat source.
Figure 3:
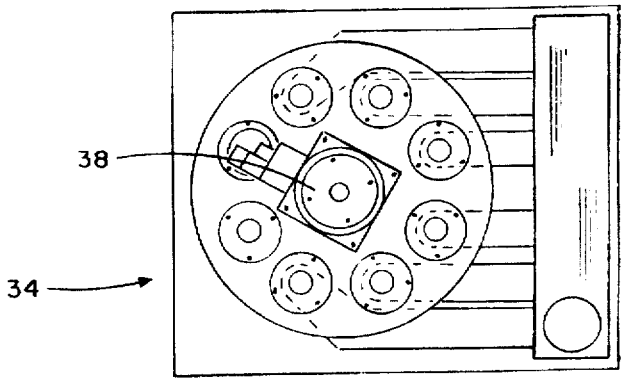
FIG. 3 is a plan view of the bottom of the shrinker showing the indexer, the air communicating conduits to each heating chamber, and the input and input ports.
Figure 6:
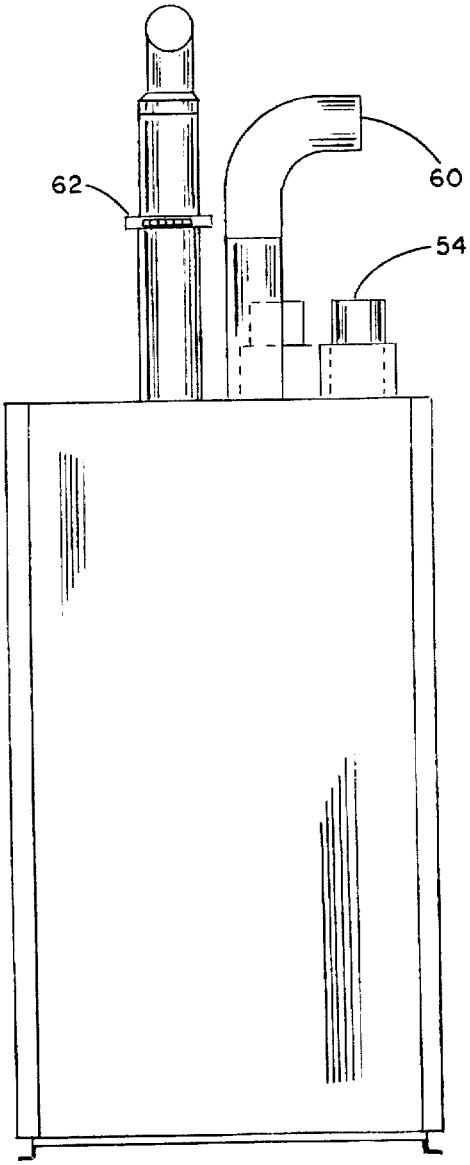
FIG. 6 is a side elevational and partial view of the shrinker showing the heat input and output lines, and the garment input and output lines, the input line being controlled by a finger gate.
Figure 4:
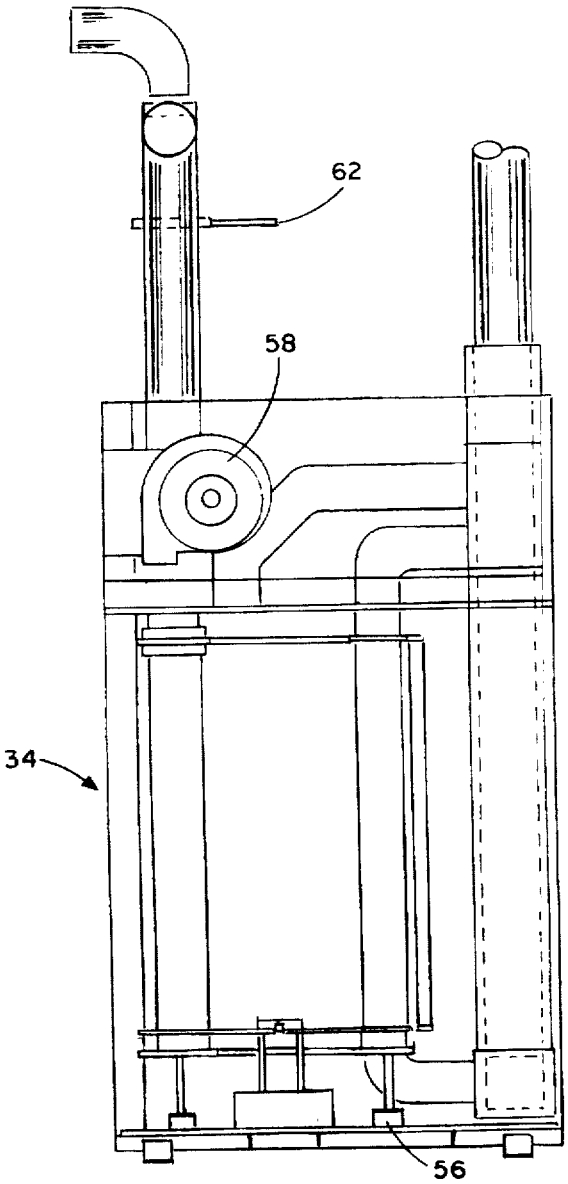
FIG. 4 is a side elevational and partial view of the shrinker showing several chambers, the air input conduit, and the unloading blower.

In utilizing the present invention, the functional floor of a hosiery plant shown generally as 20 supports numerous lines of circular knitting machines, each of which is shown generally as 22. Each line is aligned as illustrated in FIG. 1 to provide easy access to knitters and fixers, special terms classifying those skilled in operating and repairing such machines. The knitting section of the plant takes up a sizeable portion of the plant's floor space 24, and adjacent to it are a plurality of aligned automatic pick-up, cut and sew machines for completely fabricating plant pantyhose garments which are now being used in some very modern hosiery plants. Representative of such machines are the disclosures of U.S. Pat. Nos. 5,040,475 and 5,165,355.

During normal operation in such a plant, knitted tubes are produced by the knitting machines and are collected either at each machine or at a collection area at the end of each line of machines. When a suitable volume has accumulated, a worker will move to the accumulation area with a cart or buggy, load the blanks and take them to a staging area for shrinking where they are loaded into a dryer/tumbler, thereafter reloaded on the cart and then taken to bin 28 where they are deposited. An automatic pick-up device (not shown) operable with the bin, sequentially engages a blank and moves it to the crotch sewing station 30 where two blanks are slit and joined together automatically. The joined blanks are then moved on to the toe sewing station 32 where they are mounted on frames, inspected and closed in the toe area. They are subsequently automatically removed from the machine and captured in a preselected fashion for packaging.

The present invention includes a shrink apparatus shown generally as 34 which is positioned adjacent bin 28. The collected blanks from a line **22*a* of knitting machines are then conveyed in overhead conduits by air to shrinker 34, the details of which will be described in more detail subsequently. After heating and shrinking in shrinker 34 for a predetermined period of time, the blanks are automatically conveyed to the cutting and sewing station 30** where they are ultimately finished into pantyhose garments.

The knitting machines discussed herein are commonly used, commercially available machines, in which no proprietary interest is claimed per se. The automatic pick-up, cut and sew apparatus previously discussed is the subject of U.S. Pat. Nos. 5,040,475 and 5,165,365 mentioned earlier, the contents of which are incorporated herein by reference. The shrink apparatus is the crux of the present invention which replaces the conventional scour and wash function in the manufacture of ladies fashion hosiery and provides an automatic manufacturing step between the knitting and cut and sew operations conventionally utilized.

Shrink apparatus 34 includes an indexer 38 and, in the embodiment described, eight chambers 40, one 42 for loading, one 44 for unloading and six 46 for heating. A steam coil unit shown generally as 48 along with appropriate controls, provides a heat source for shrinker 34, and hot air blower 50 forces the created hot air through input conduit 52 and into heat generating input end 54 of shrinker 34. Hot air is directed into the lower floor end of shrinker 34 so that hot air can be injected into chambers 46 in an upward direction to gently lift and fluff the blanks collected therein.

Air clamps 56 are utilized to close the chambers when indexer 38 has been advanced to a new position so that all of the hot air introduced into chambers 46 can move upwardly therethrough to perform the drying and shrinking operation. An unloading blower 58 is utilized to discharge the accumulated blanks from chamber 44, through output conduit 60, through an overhead conduit (not shown), and into bin 28. A finger gate 62 is used to trap the blanks in the input conduit to prevent overloading of chamber 42. Hot air gate 64 cooperatively functions with air clamps 56 to allow heated air to circulate through the chambers.

Figure 7:
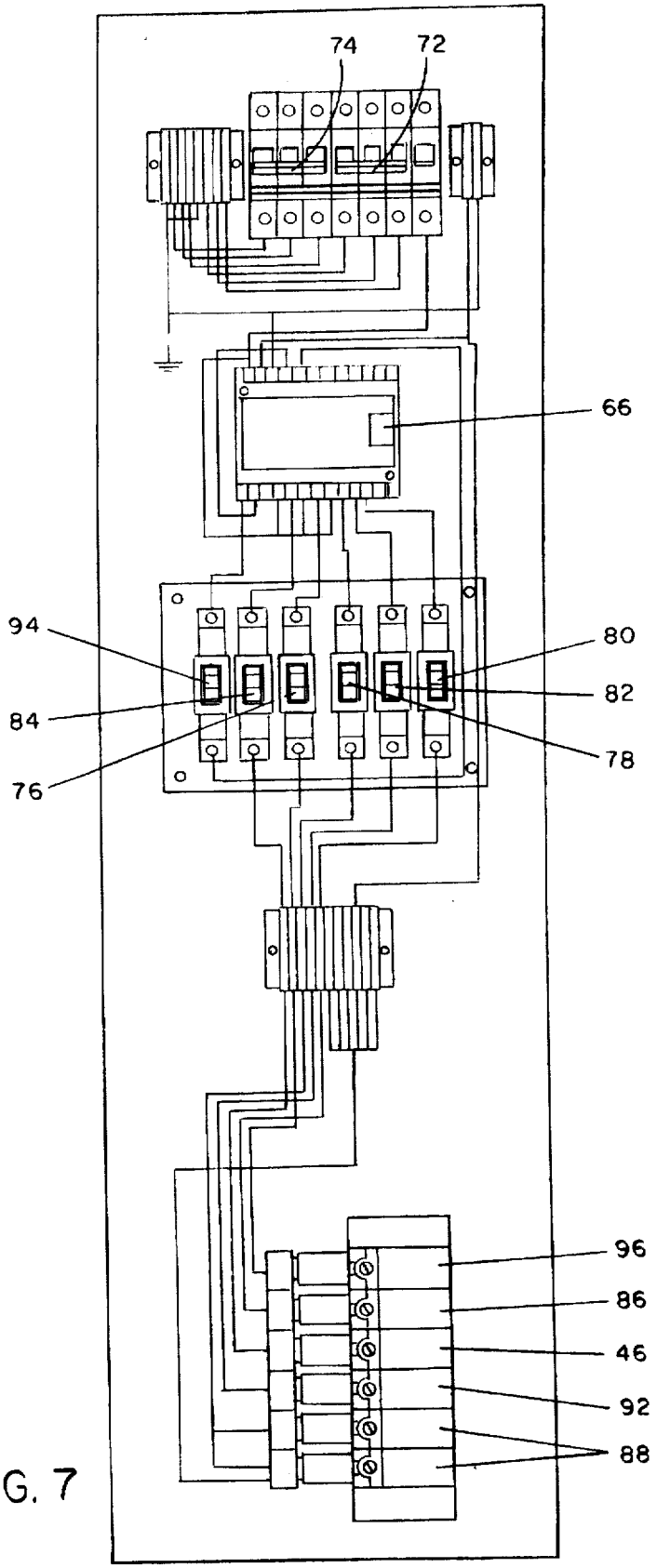
FIG. 7 is a schematic diagram showing the programmable controller and its associated circuitry operable to control the operation of the shrink apparatus.

A programmable controller shown generally as 66 controls the operation of shrinker 34 and is shown with its associated circuitry in FIG. 7. Blowers are operated by large motors 68, 70, motor 68 providing the power for the recirculation blower and motor 70 powering the unload blower for shrinker 34. Motors 68, 70 are 460 volt ac motors which continuously run during the entire cycle of operation for shrinker 34. Protective circuit breakers 72, 74 also provide manual means for disabling or deactivating motors 68, 70.

Controller 66 selectively operates switches and valves that control the various actions of the shrinker. For example, a finger gate disable switch 76 is activated and deactivated by controller 66 to close and open finger gate 62 when such operations are required. Similarly, air clamp disable switch 78 is selectively operated by controller 66 to activate and reset air clamps 56 as needed. An unload blower disable switch 80 is operated by controller 66 to activate and deactivate the unload blower causing the discharge of blanks from the chambers into the collecting bin of the cut and sew automated equipment. An indexer disable switch 82 is activated by the controller to start and reset the indexer to rotate the heating chambers. A recirculation disable switch 84 is also selectively operated by controller 66 to activate and deactivate the recirculation blower.

The various disable switches 76, 78, 80, 82 and 84, when activated, allow programmable controller 66 to energize a finger gate solenoid 86, an air clamps solenoid 88, an unload blower solenoid 90, an indexer solenoid 92, and a recirculation gate solenoid 94, all of which control the actual operation of the controlled mechanism.

The programmable controller is responsive to 120 volt alternating current, appropriately fused and grounded as shown. An input enable switch 94 is manually operable to activate or deactivate controller 66.

In operation of the system, hosiery blanks are transported from a knitting machine grouping consisting of approximately 18 machines to the shrinker through plastic conduit having a diameter of about five inches through a conventional pneumatic or other conveying system like that used, for example, in U.S. Pat. No. 5,040,475. The conduit connects with inlet 42 filling the chamber in the load position with 11 to 14 hosiery blanks during the allotted cycle time. Operation time is one minute; i.e., chambers 42, 44 and 46 will sit in position for 54 seconds to allow for loading/heating/unloading and then rotate clockwise to the next position. Preparation and turning time takes about six seconds.

When one minute elapses, hot air gate 64 closes preventing the circulation of hot air through the chambers, finger gate 62 closes trapping the hosiery in the transport line to prevent additional loading of chamber 42, air clamps 56 retract to open the chambers and allow clearance for turning, and indexer 38 is activated to move the chambers in a clockwise direction (45 degrees) to the next position. Once the chambers are in position and locked, air clamps 56 close off the chambers, finger gate 62 opens to begin loading empty chamber 42, hot air gate 64 is opened and allows heated air to circulate through the six chambers 46 in the heat position. Hot air is provided by blower 50 which blows the air over fins on a steam coil 48 achieving a temperature of approximately 240 degrees Fahrenheit as it enters the chambers for shrinking the hosiery blanks.

This is a closed air system, and ambient air does not enter, thereby preventing the plant conditioned air from being pulled into shrinker 34. Additionally, the heated air is not discharged into the plant conditioned air but is recirculated within the closed system. When the hosiery blanks have been heated and shrunk, unloading blower 58 is activated to empty the contents of chamber 44 into the bin either directly or through an overhead conduit.

All styles of pantyhose production can be subjected to the shrinker, including those made with bicomponent yarns and fine denier yarns that normally require scouring. Even the finest denier hosiery blanks that might still need scouring after going through shrinker 34 can be fabricated into pantyhose garments before the scouring operation. Garments produced through use of shrinker 34 are subjected to more consistent shrinkage than conventional scouring techniques provide. Productivity results are up 10%, enabling a production output of 34 dozen per hour per machine, resulting in significant cost savings per dozen.

The conventional process for handling knit fabric utilizing the three traditional functions of knitting, steam tumbling and scouring, and cut and sew operations becomes, through the use of shrinker 34, a truly automated process which includes knitting a plurality of cylindrical blanks sequentially, automatically transferring the knit blanks sequentially to a shrink apparatus, continuously shrinking the transferred blanks for a predetermined period of time, and automatically transferring the shrunk blanks from the shrink apparatus to the cut and sew automated equipment.

From the foregoing, it is apparent that a process and apparatus for handling knit fabric, particularly knit cylindrical hosiery blanks, made in accordance with the present invention, is well-adapted to attain the ends and objectives hereinbefore set forth. As various embodiments may be made of the invention, and as changes might be made in the embodiments above set forth, it is to be understood that all matters previously set forth and shown in the accompanying drawings are to be interpreted as illustrative and not in a limiting sense.

What is claimed is:

1. A process for handling knitted fabric comprising the steps of: knitting a plurality of cylindrical blanks sequentially; automatically transferring the knitted blanks sequentially to a shrink apparatus; continuously shrinking the transferred blanks for a predetermined period of time; automatically transferring the shrunken blanks from the shrink apparatus to a remote location; and providing an indexer for carrying heating chambers and a programmable controller for selectively displacing the indexer and to coordinate the sequence of transferring the knitted blanks to the shrink apparatus, shrinking the transfer of blanks for a predetermined period of time, and automatically transferring the shrunken blanks to a remote location.

2. The process as claimed in claim 1 further comprising providing a predetermined number of the chambers on the shrink apparatus for shrinking the transferred blanks.

3. The process as claimed in claim 2 wherein the blanks of each chamber are transferred to the remote location.

4. The process as claimed in claim 1 further comprising providing the remote location with automatic pick-up, cut and sew apparatus for completely fabricating pantyhose garments.

5. The process as claimed in claim 4 wherein the blanks of each chamber are simultaneously transferred to the remote location.

6. The process as claimed in claim 1 further comprising providing the remote location with an automatic packaging apparatus for completely collecting and packaging the shrunken blanks for shipment.

7. The process as claimed in claim 6 further comprising providing a predetermined number of chambers on the shrink apparatus for shrinking the transferred blanks.

8. The process as claimed in claim 7 wherein the blanks of each chamber are transferred simultaneously to the remote location.

9. Apparatus for heating and shrinking knitted fabric comprising: an indexer, a plurality of heating and shrinking chambers mounted on the indexer; heat generating means having input and output ends; heat input means connecting the heat generating means output end with the heating and shrinking chamber; heat output means connecting the heating and shrinking chambers with the heat generating input end; input means for conveying knitted fabric to the heating and shrinking chambers; output means for removing the knitted fabric from the heating and shrinking chambers to a remote location; and a programmable controller for selectively displacing the indexer to coordinate the operation of the heat generating means with and move the heating and shrinking chamber sequentially by the input means, the heat input end, the output means, and the heat output end.

10. Apparatus as claimed in claim 9 wherein the input means includes a blower for moving the knitted fabric to the heating and shrinking chambers and gate means for selectively controlling the movement of the knitted fabric to the heating and shrinking chambers.

11. Apparatus as claimed in claim 9 wherein the heating and shrinking chambers have closing air clamps associated therewith.

12. Apparatus as claimed in claim 10 wherein the heating and shrinking chambers have closing air clamps associated therewith.

* * * * *